US010710843B2

(12) United States Patent
Kulak et al.

(10) Patent No.: US 10,710,843 B2
(45) Date of Patent: Jul. 14, 2020

(54) CAR DOOR INTERLOCK WITH SILL LOCK

(71) Applicant: Otis Elevator Company, Farmington, CT (US)

(72) Inventors: Richard E. Kulak, Bristol, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 228 days.

(21) Appl. No.: 15/749,685

(22) PCT Filed: Aug. 2, 2016

(86) PCT No.: PCT/US2016/045156

§ 371 (c)(1),
(2) Date: Feb. 1, 2018

(87) PCT Pub. No.: WO2017/023928

PCT Pub. Date: Feb. 9, 2017

(65) Prior Publication Data

US 2018/0229972 A1 Aug. 16, 2018

Related U.S. Application Data

(60) Provisional application No. 62/200,912, filed on Aug. 4, 2015.

(51) Int. Cl.

| | |
|---|---|
| ***B66B 13/18*** | (2006.01) |
| ***B66B 13/20*** | (2006.01) |
| ***B66B 13/16*** | (2006.01) |

(52) U.S. Cl.

CPC ..... *B66B 13/18* (2013.01); *B66B 13/16* (2013.01); *B66B 13/20* (2013.01); *E05Y 2201/22* (2013.01)

(58) Field of Classification Search

CPC ..... B66B 13/12; B66B 13/18; B66B 13/20
See application file for complete search history.

(56) References Cited

U.S. PATENT DOCUMENTS 2,280,805 A * 4/1942 Dodd ..... B66B 13/20 187/280
4,313,525 A 2/1982 McDonald
(Continued)

FOREIGN PATENT DOCUMENTS

CN 101132983 A 2/2008
CN 101663224 A 3/2010
(Continued)

OTHER PUBLICATIONS

PCT ISR Written Opinion; International Application No. PCT/US2016/045156; International Filing Date: Aug. 2, 2016, dated Oct. 18, 2016, pp. 1-5.
(Continued)

*Primary Examiner* — Minh Truong
(74) *Attorney, Agent, or Firm* — Cantor Colburn LLP

(57) ABSTRACT

A lock assembly for an elevator car door is provided including a car mechanism configured to move from a first position to a second position upon detection of a known condition. A contactor is mounted adjacent a lower portion of the elevator car door and is operably coupled to the car door mechanism. The contact is movable in response to movement of the car door mechanism to lock and unlock a portion of the elevator car door.

20 Claims, 9 Drawing Sheets

(56) References Cited

U.S. PATENT DOCUMENTS

| | | | | |
|---|---|---|---|---|
| 4,491,200 | A | 1/1985 | Thompson et al. | |
| 4,529,065 | A * | 7/1985 | Kraft | B66B 13/08 187/314 |
| 4,926,974 | A | 5/1990 | Morris et al. | |
| 4,947,964 | A * | 8/1990 | Husmann | B66B 13/12 187/319 |
| 5,139,112 | A * | 8/1992 | Tonna | B66B 13/12 187/331 |
| 5,732,796 | A | 3/1998 | Ahigian et al. | |
| 5,819,877 | A | 10/1998 | Rivera et al. | |
| 5,899,302 | A | 5/1999 | O'Donnell | |
| 5,918,706 | A | 7/1999 | Kowalczyk et al. | |
| 5,988,320 | A | 11/1999 | Mittermayr | |
| 6,021,871 | A | 2/2000 | Grabner | |
| 6,062,345 | A | 5/2000 | Olofsson | |
| 6,164,417 | A | 12/2000 | Oberleitner | |
| 6,173,815 | B1 | 1/2001 | Mittermayr | |
| 6,189,658 | B1 | 2/2001 | Karner | |
| 6,446,759 | B1 | 9/2002 | Kulak et al. | |
| 7,077,242 | B2 | 7/2006 | Cocher | |
| 7,097,002 | B2 | 8/2006 | Bisang et al. | |
| 7,100,745 | B2 | 9/2006 | Bisang et al. | |
| 7,252,179 | B2 | 8/2007 | Oberleitner | |
| 7,255,203 | B2 | 8/2007 | Rennetaud et al. | |
| 7,350,623 | B2 | 4/2008 | Kinoshita et al. | |
| 7,370,731 | B2 | 5/2008 | Cocher | |
| 7,413,058 | B2 | 8/2008 | Zappa | |
| 7,607,517 | B2 | 10/2009 | Karner et al. | |
| 7,681,695 | B2 | 3/2010 | Christen | |
| 9,637,350 | B2 * | 5/2017 | Mittermayr | B66B 13/12 |
| 2007/0205059 | A1 | 9/2007 | Badaoui et al. | |
| 2008/0271958 | A1 | 11/2008 | Lelic et al. | |
| 2013/0048433 | A1 | 2/2013 | Tantis et al. | |

FOREIGN PATENT DOCUMENTS

| | | | |
|---|---|---|---|
| CN | 102015510 | A | 4/2011 |
| CN | 102414113 | A | 4/2012 |
| CN | 103562116 | A | 2/2014 |
| EP | 1266860 | A1 | 12/2002 |
| EP | 1621511 | A2 | 2/2006 |
| EP | 1841682 | A1 | 10/2007 |
| GB | 2112352 | A | 7/1983 |
| JP | 2014118258 | A | 6/2014 |
| WO | 2005077808 | A2 | 8/2005 |
| WO | 2005123562 | A1 | 12/2005 |
| WO | 2006097997 | A1 | 9/2006 |
| WO | 2014122358 | A1 | 8/2014 |
| WO | 2015008386 | A1 | 1/2015 |
| WO | 2015041772 | A1 | 3/2015 |

OTHER PUBLICATIONS

PCT Notification of Transmittal of the International Search Report; International Application No. PCT/US2016/045156; International Filing Date: Aug. 2, 2016, dated Oct. 18, 2016, pp. 1-5.

Chinese Office Action; Chinese Application No. 201680045520.1; dated Jun. 25, 2019; 7 pages.

International Preliminary Report on Patentability; International Application No. PCT/US2016/045156; International Filing Date: Aug. 2, 2016; dated Feb. 6, 2018; 6 pages.

* cited by examiner

CAR DOOR INTERLOCK WITH SILL LOCK

CROSS REFERENCE TO RELATED APPLICATIONS

This application is a National Stage application of PCT/US2016/045156, filed Aug. 2, 2016, which claims the benefit of U.S. Provisional Application No. 62/200,912, filed Aug. 4, 2015, both of which are incorporated by reference in their entirety herein.

BACKGROUND

The present disclosure relates to an elevator system, and more specifically to a method and means for engaging elevator car and landing doors.

In a typical elevator or lift installation, the vertically moving elevator car is positioned so as to align its entrance with corresponding openings at a plurality of landings in a multi-floor building. Modern installations typically have one or more horizontally sliding doors disposed on the elevator car and at least one sliding door disposed on each of the landing floors, all of which remain closed during movement of the elevator car within a hoistway.

Upon arrival of the elevator car at a floor or landing, a door opening mechanism is activated which drives the elevator car doors horizontally for permitting access to the elevator car. In typical installations, one or more vanes projecting from the surface of the elevator car door in the direction of the adjacent landing door engage various structures, for example vanes, rollers, or other protrusions projecting from the landing door, to drive the landing door horizontally, thereby permitting passengers to traverse between the car and landing.

Elevator codes require that the elevator landing doors remain fastened securely against unauthorized entry unless an elevator car is positioned directly adjacent the landing. Likewise, in certain countries, the elevator car must remain latched against manual movement unless the car is positioned so as to register with a landing. Various mechanisms and systems have been proposed in the prior art to secure and unsecure landing and elevator car doors as the elevator car traverses the elevator hoistway. Various mechanical and electrical interlock systems used to date have the disadvantage of being complex and subject to malfunction and/or frequent service requirements. Existing interlock systems are typically actuated by solenoids or are mechanically linked to the door coupler. These electrical systems have start delays and require a battery backup in the event of a loss of power. Mechanical systems are often noisy and require a complex set of linkages, cams, and springs to function.

SUMMARY

According to an embodiment, a lock assembly for an elevator car door is provided including a car mechanism configured to move from a first position to a second position upon detection of a known condition. A contactor is mounted adjacent a lower portion of the elevator car door and is operably coupled to the car door mechanism. The contact is movable in response to movement of the car door mechanism to lock and unlock a portion of the elevator car door.

In addition to one or more of the features described above, or as an alternative, in further embodiments the contactor includes a biasing mechanism configured to bias the contactor into a locked position.

In addition to one or more of the features described above, or as an alternative, in further embodiments the contactor is a spring pin.

In addition to one or more of the features described above, or as an alternative, in further embodiments the contactor is mounted to the elevator car door and engages a car door sill.

In addition to one or more of the features described above, or as an alternative, in further embodiments movement of the car door mechanism between the first position and the second position is configured to transmit a force to the contactor, thereby causing the contactor to move between a locked position and an unlocked position.

In addition to one or more of the features described above, or as an alternative, in further embodiments the contactor and the car door mechanism are connected by a cable.

In addition to one or more of the features described above, or as an alternative, in further embodiments the car door mechanism is a car door interlock.

In addition to one or more of the features described above, or as an alternative, in further embodiments the car door mechanism is a door coupler.

According to another embodiment, an elevator system is provided including an elevator car movable within a hoistway between a plurality of landings. The elevator car includes an elevator car door movable between an open position and a closed position. A car door mechanism is configured to determine if the elevator car is positioned within a landing zone. A lock assembly is operably coupled to both the car door mechanism and a lower portion of the elevator car. The lock assembly is configured to lock and unlock a portion of the elevator car door.

In addition to one or more of the features described above, or as an alternative, in further embodiments the lock assembly is configured to lock a lower portion of the elevator car door.

In addition to one or more of the features described above, or as an alternative, in further embodiments the lock assembly includes a contactor movable between a first position and a second position. The contactor is arranged in a first position when the elevator car door is locked and the contactor is arranged in a second position when the elevator car door is unlocked.

In addition to one or more of the features described above, or as an alternative, in further embodiments the contactor includes a biasing mechanism configured to bias the contactor into the first position.

In addition to one or more of the features described above, or as an alternative, in further embodiments the contactor is a spring pin.

In addition to one or more of the features described above, or as an alternative, in further embodiments movement of the car door mechanism after determining that the elevator car is positioned within the landing door zone is configured to transmit a force to the contactor, thereby causing the contactor to move between the first position and the second position.

In addition to one or more of the features described above, or as an alternative, in further embodiments the car door mechanism is a car door interlock.

In addition to one or more of the features described above, or as an alternative, in further embodiments the car door interlock includes an engagement latch configured to move between a first position and a second position upon determining that the elevator car is positioned within the landing door zone, the engagement latch being operably coupled to the lock assembly.

In addition to one or more of the features described above, or as an alternative, in further embodiments the lock assembly is operably coupled to the car door mechanism via a cable.

In addition to one or more of the features described above, or as an alternative, in further embodiments the lock assembly is mounted to the elevator car and locks a lower portion of the elevator car door.

In addition to one or more of the features described above, or as an alternative, in further embodiments operation of the car door interlock is driven by a door operator mounted to the elevator car.

In addition to one or more of the features described above, or as an alternative, in further embodiments a locking mechanism is operably coupled to the car door mechanism. The locking mechanism is configured to lock an upper portion of the elevator car.

BRIEF DESCRIPTION OF THE DRAWINGS

The foregoing and other features and advantages of embodiments are apparent from the following detailed description, taken in conjunction with the accompanying drawings, in which.

The detailed description describes exemplary embodiments, together with some of the advantages and features thereof, by way of example with reference to the drawings.

DETAILED DESCRIPTION

Figure 1:
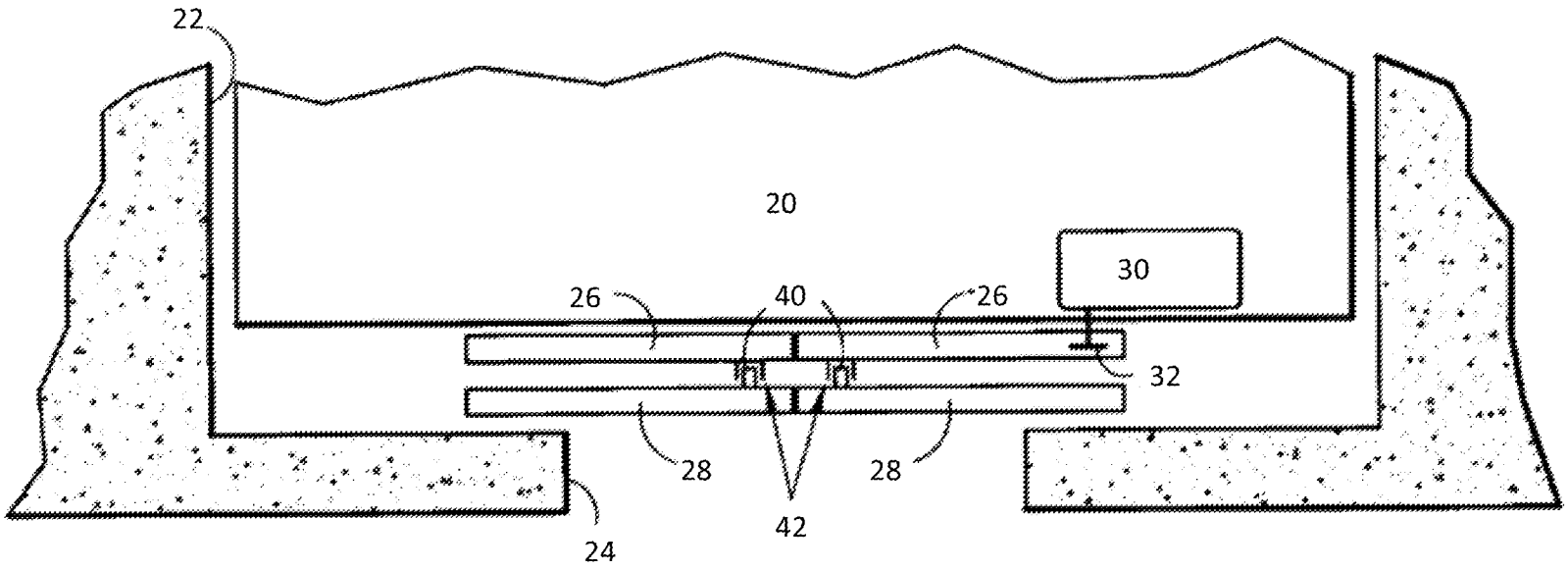
FIG. 1 is a plan view of an elevator car in a hoistway where the elevator car doors and the landing doors are in a closed position.
Figure 2:
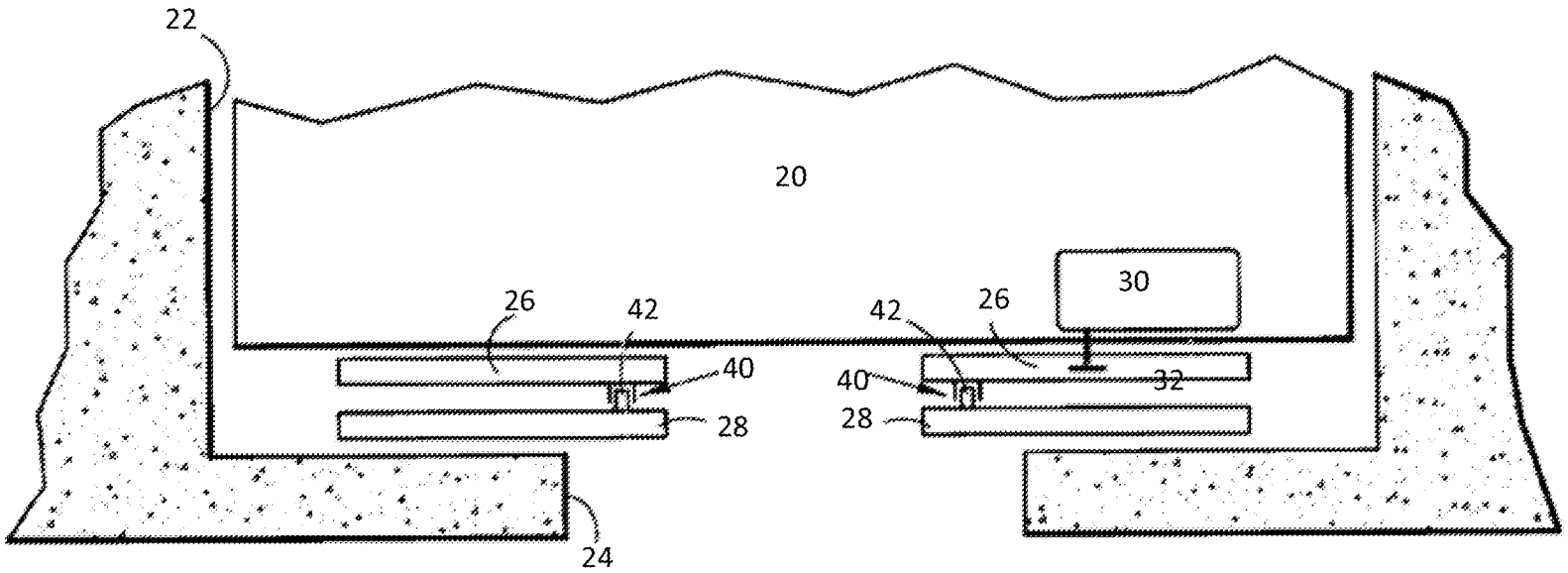
FIG. 2 is a plan view of an elevator car in a hoistway where the elevator car doors and the landing doors in a partially opened position.
Figure 3:
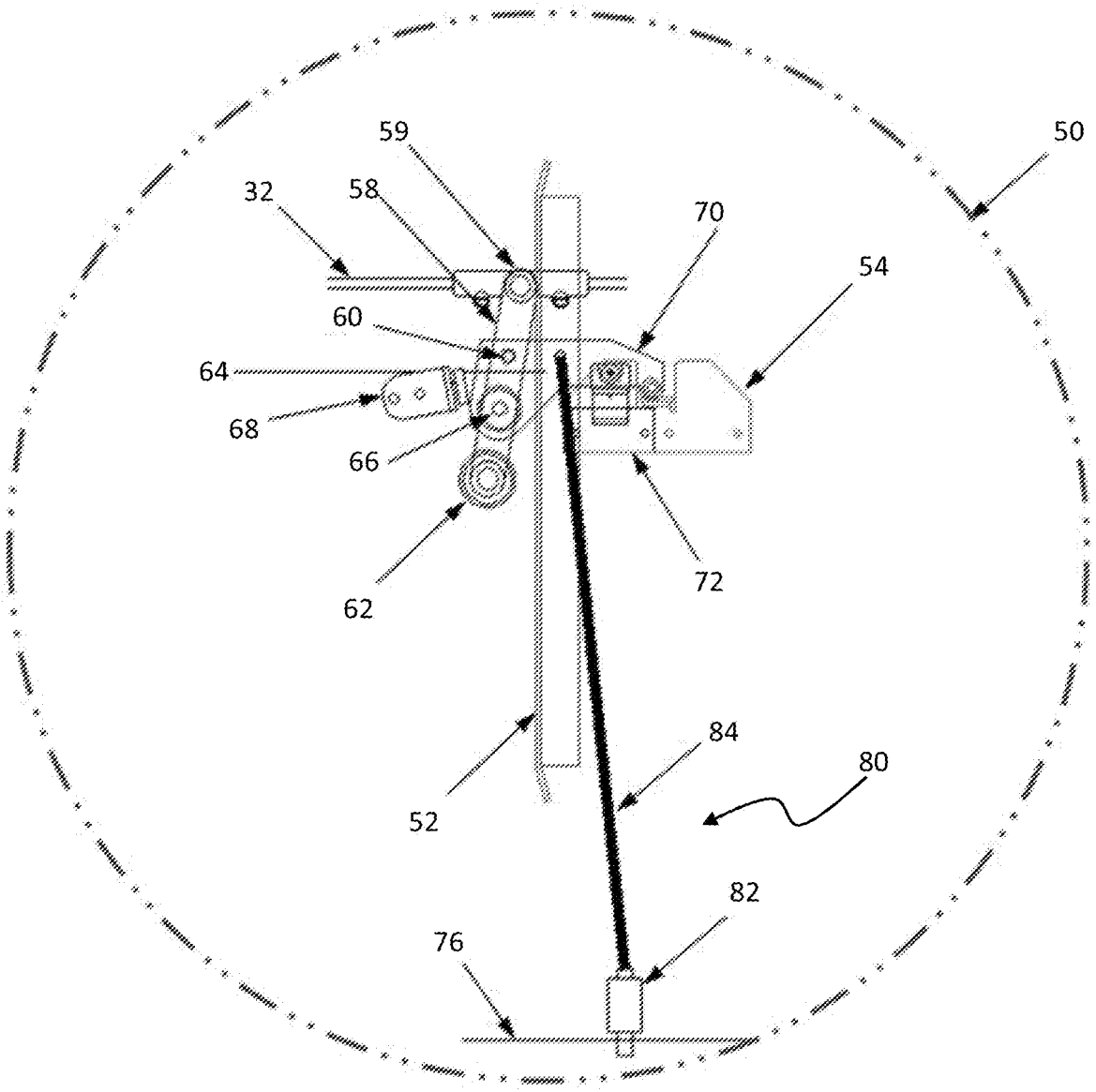
FIG. 3 is a detailed front view of a car door interlock device according to an embodiment.

Referring now to the FIGS. 1 and 2, a typical elevator installation is illustrated. FIG. 1 shows a plan view of an elevator car 20 disposed in a vertical hoistway 22 and positioned so as to correspond to a landing 24 having an opening. Elevator car doors 26, are shown in correspondence with laterally sliding landing doors 28. As is typical in such installations, the elevator car doors 26 are actuated by a door operator 30, shown disposed atop the elevator car 20 and having a drive belt 32, or other drive mechanism. FIG. 2 shows the arrangement of FIG. 1 wherein the elevator doors 26 and the landing doors 28 are in a partially opened condition.

A door coupler 40 disposed on the elevator doors 26 is shown engaged with a corresponding protrusion 42 which extends inwardly from the landing doors 28. The protrusions 42 may be any sort of raised boss, bumper, rod, or roller, configured to provide a simple and effective means for enabling the elevator door coupler 40 to engage and move the landing doors 28. As will be appreciated by those skilled in the art, it is desirable that the door coupler 40 firmly grip the landing door protrusion 42 when the elevator and landing doors 26, 28 are operated. In addition, it is also desirable that the coupler 40 completely release said protrusions 42 and maintain sufficient running clearance as the elevator car 20 moves vertically through the hoistway 22.

The door coupler 40 is configured to operate only once it has been determined that the elevator car 20 is positioned within a landing door zone, adjacent at least one landing door 28. In one embodiment, a car door interlock 50 is used to determine whether the elevator car 20 is appropriately positioned within a landing door zone. An example of a car door interlock 50 is illustrated in FIGS. 3-8. As shown, a sensing vane 52 is configured to identify the landing door zone. In the illustrated, non-limiting embodiment, the sensing vane 52 is a fixed vane mounted to a landing door 28. The car door interlock 50 includes a lock member 54 mounted to a ground component, such as the car door header 56 for example. The lock member 54 is configured to lock an upper portion of the elevator car doors 26.

A link arm 58 is coupled, such as at a first end 59 for example, to the drive mechanism 32 of the door operator 30. As the door operator 30 moves the drive mechanism 32, the drive mechanism 32 is configured to rotate the link arm 58 about a pivot pin 60. A sensing roller 62 is coupled to a portion of the link arm 58, for example the second end thereof. In addition, an engagement latch 64 is pivotally connected to the link arm 58 and to the car door hanger at pin 66. A bumper 68 is positioned generally adjacent the link arm 58 and a portion of the engagement latch 64. The bumper 68 is configured to limit rotation of the engagement latch 64 about the pivot pin 66.

When the elevator car doors 26 are in a closed position, the engagement latch 64 is oriented generally horizontally such that an engagement hook 70 located at an end of the engagement latch 64 is arranged in contact with an electrical switch 72 of the lock mechanism 54. This contact sends a signal to the safety chain of the elevator system confirming that the elevator car doors 26 are closed.

Figure 4:
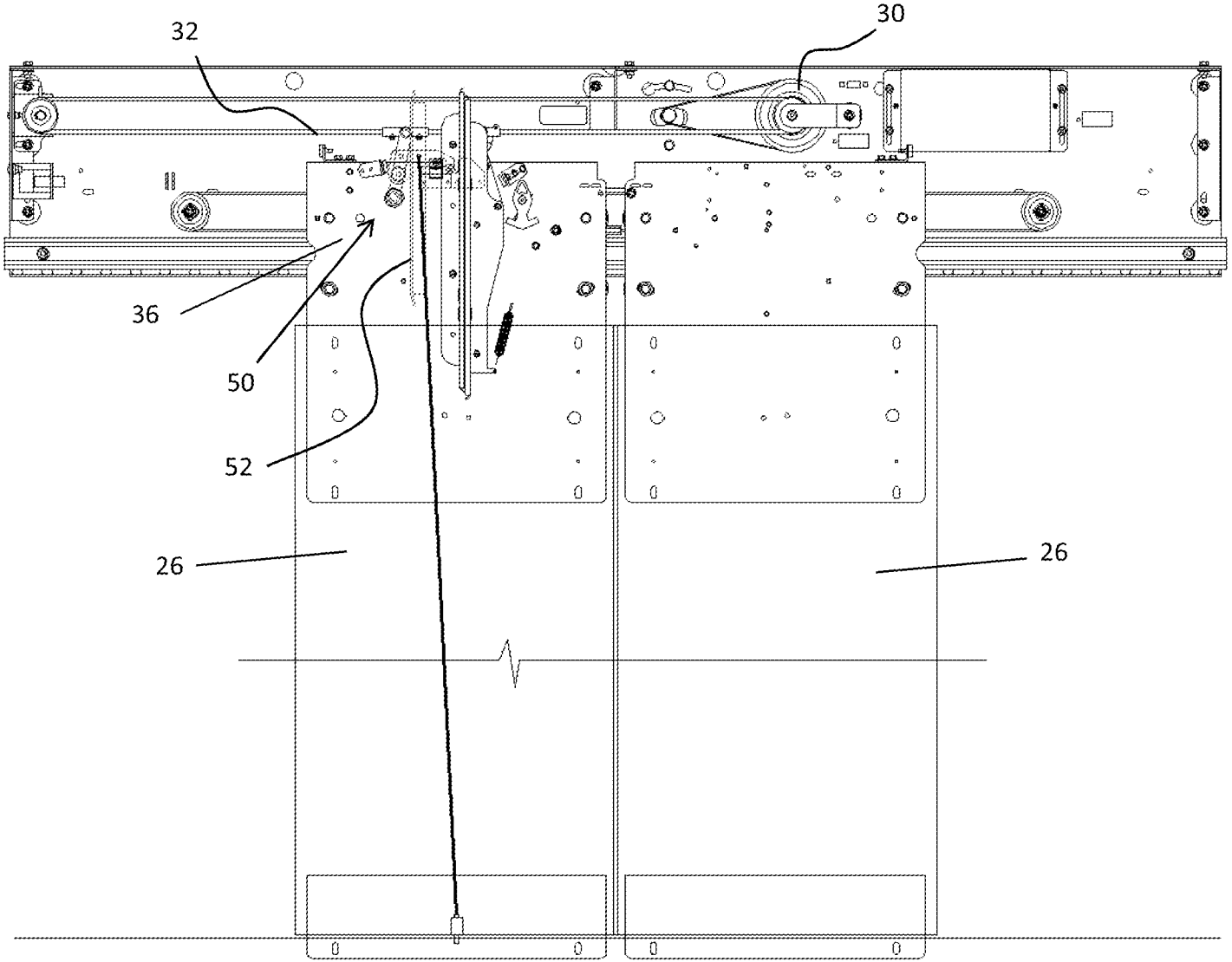
FIG. 4 is a front view of elevator car doors and the car door interlock when the elevator car is within a landing door zone according to an embodiment.
Figure 5:
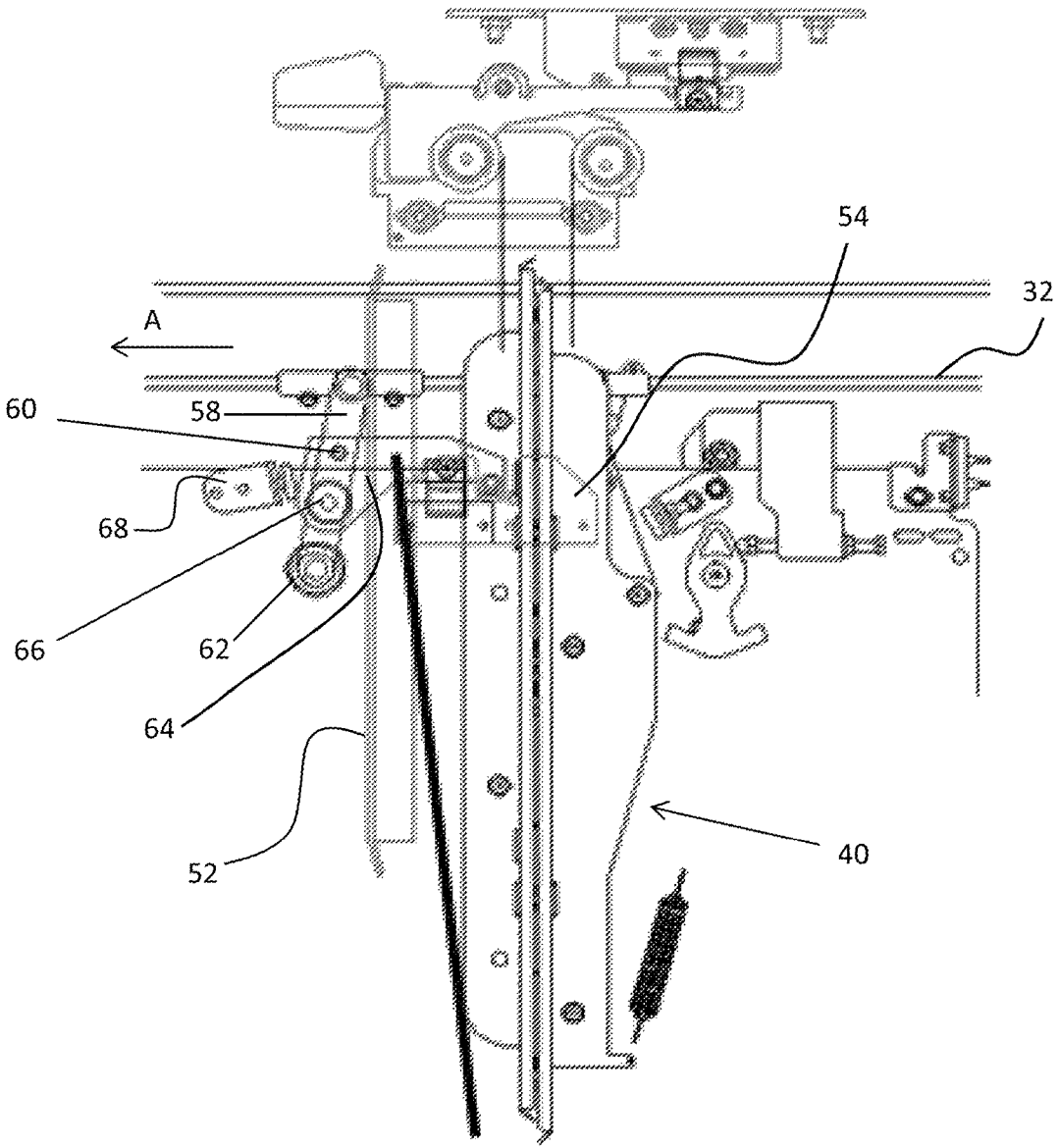
FIG. 5 is a detailed view of the car door interlock of FIG. 4 according to an embodiment.
Figure 6:
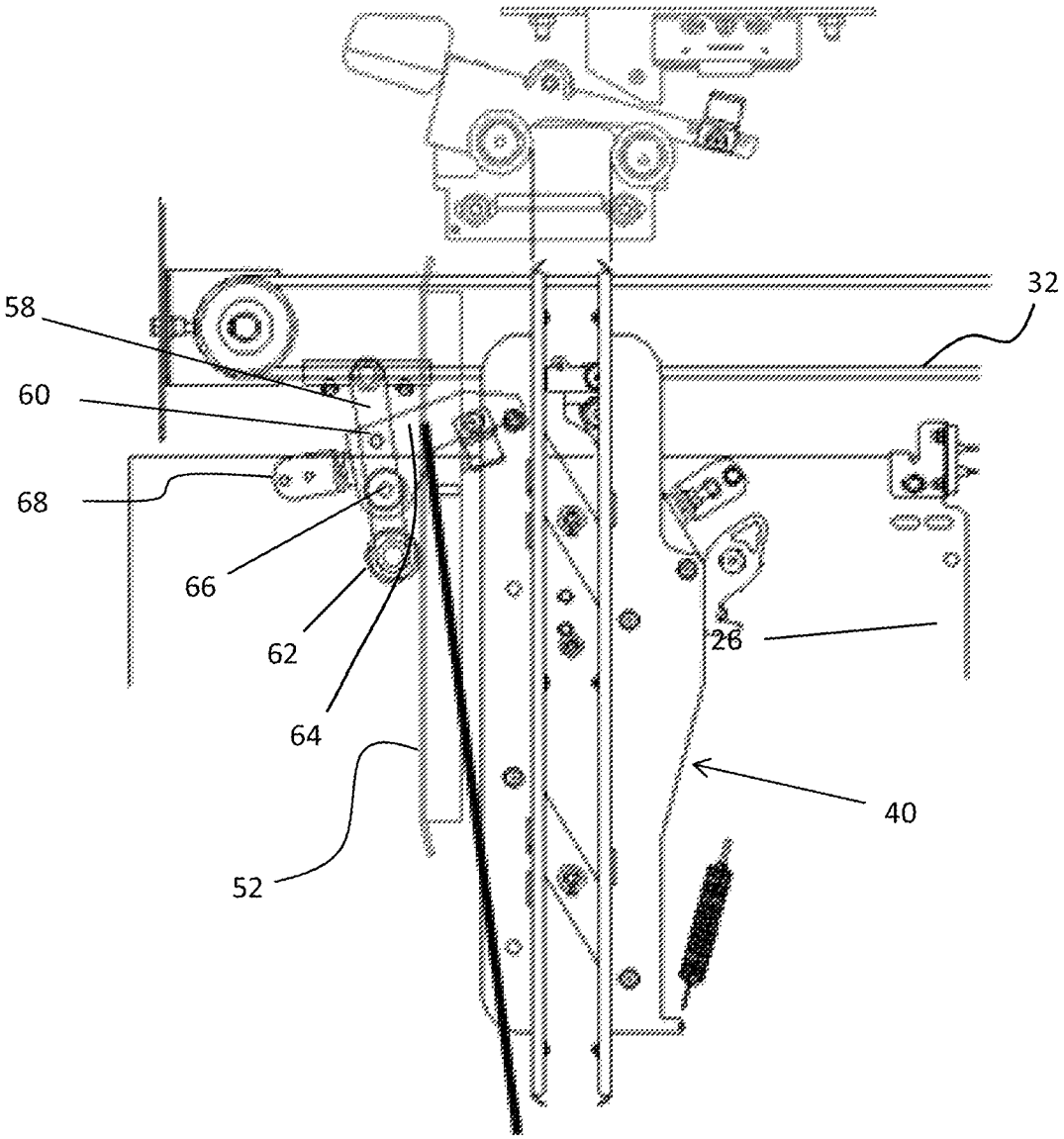
FIG. 6 is a front of the car door interlock when the elevator car doors and landing doors are coupled and in an open position according to an embodiment.
Figure 7:
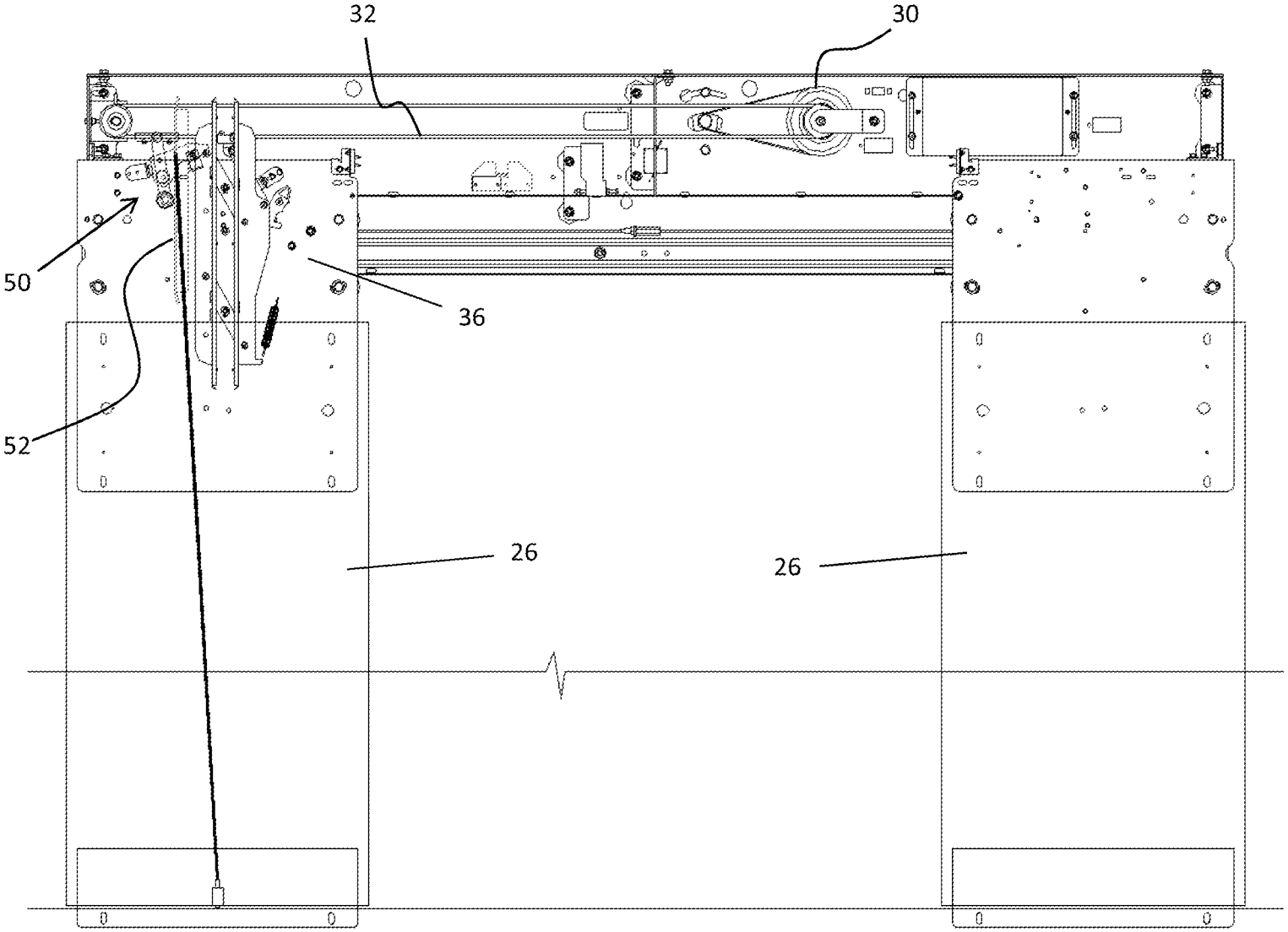
FIG. 7 is a detailed view of the car door interlock of FIG. 6 according to an embodiment.

The elevator car doors 26 are closed in FIGS. 4 and 5. As the elevator car 20 eaters a door landing zone, the door operator 30 actuates drive mechanism 32 in a first direction, indicated by arrow A, causing the link arm 58 to pivot about pin 60, such as in a counterclockwise direction for example. This movement of the link arm 58 causes the sensing roller 62 disposed near an end of the link arm 58 to rotate into contact with the sensing vane 52. Upon detection of the presence of the sensing vane 52, further operation of the drive mechanism 32 in the first direction causes the engagement latch 64 to pivot about pin 66 until the engagement latch 64 contacts the bumper 68 (see FIG. 7). Rotation of the engagement latch 64 about the pivot pin 66 separates the engagement hook 70 from the electrical switch 72, thereby generating a signal to the elevator controller (not shown). In this position, the car doors 26 and landing doors 28 are coupled and are able to translate to a fully open position, as shown in FIG. 6.

To close the elevator car doors 26, the door operator 30 actuates the drive mechanism 32 in a second, opposite direction, causing the link arm 58 to pivot about pin 60 and the engagement mechanism to rotate about pin 66 such that the engagement hook 70 rotates into contact with the electrical switch 72. The link arm 58 further rotates to move the roller 62 away from the sensing vane 52. In this position, the elevator car 20 is free to move throughout the hoistway 22 without interference between any of the plurality of sensing vanes 52 located at the various landings 24 and the car door interlock 50.

Figure 8:
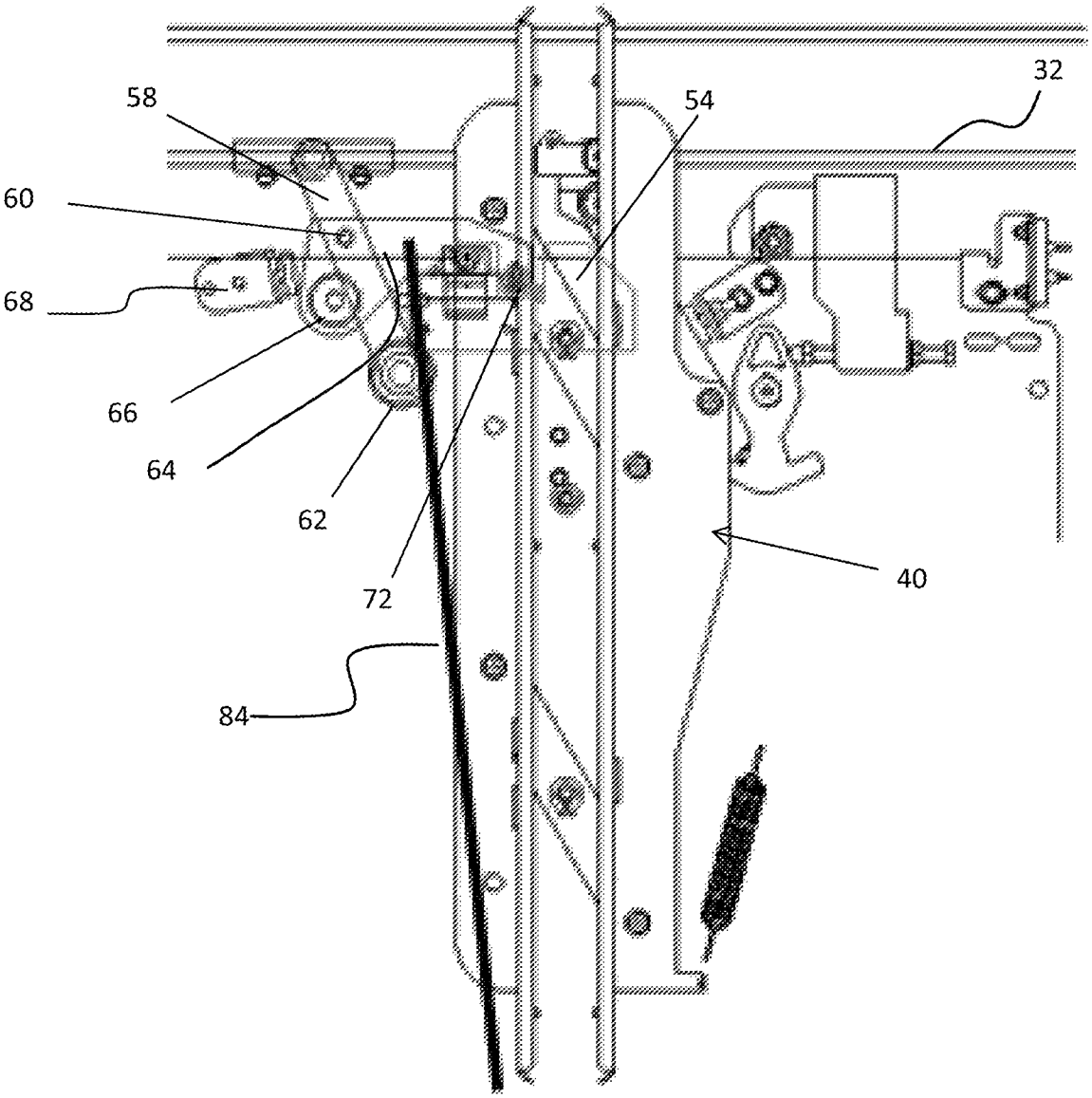
FIG. 8 is a detailed view of the car door interlock when the door operator energized when the elevator is outside a landing door zone according to an embodiment.

Referring now to FIG. 8, if the door operator 30 actuates the drive mechanism 32 when the elevator car 20 is not within a landing door zone, for example if power to the car door operator 30 is lost, the elevator car doors 26 will not open. In the absence of the sensing vane 52, operation of the door operator 30 causes the link arm 58 to rotate freely about the pivot pin 60. Without the contact between the sensing roller 62 and the sensing vane 52, the link arm 58 rotates relative to the engagement latch 64. The engagement latch 64 does not rotate about pivot 66. As a result, the engagement hook 70 remains in contact with the electrical switch 72 and the car doors 26 remain locked. The car door interlock 50 illustrated and described herein is intended as an example only and other door devices configured to detect the position of the elevator car 20 within the hoistway 22 are within the scope of the disclosure.

Alternatively, or in addition to the lock member 54 and electrical switch 72, the car door interlock 50 may include a lock assembly 80 configured to connect the car door interlock 50 to a lower portion of the elevator car 20, such as a car door sill 76 for example. In the illustrated, non-limiting embodiment, the lock assembly 80 includes a contactor 82, such as a spring loaded pin for example, mounted to the car door 26. A cable 84 or other tether extends between a portion of the engagement latch 64 and the contactor 82 and engages the car sill 76 to lock the car door 26.

Figure 9:
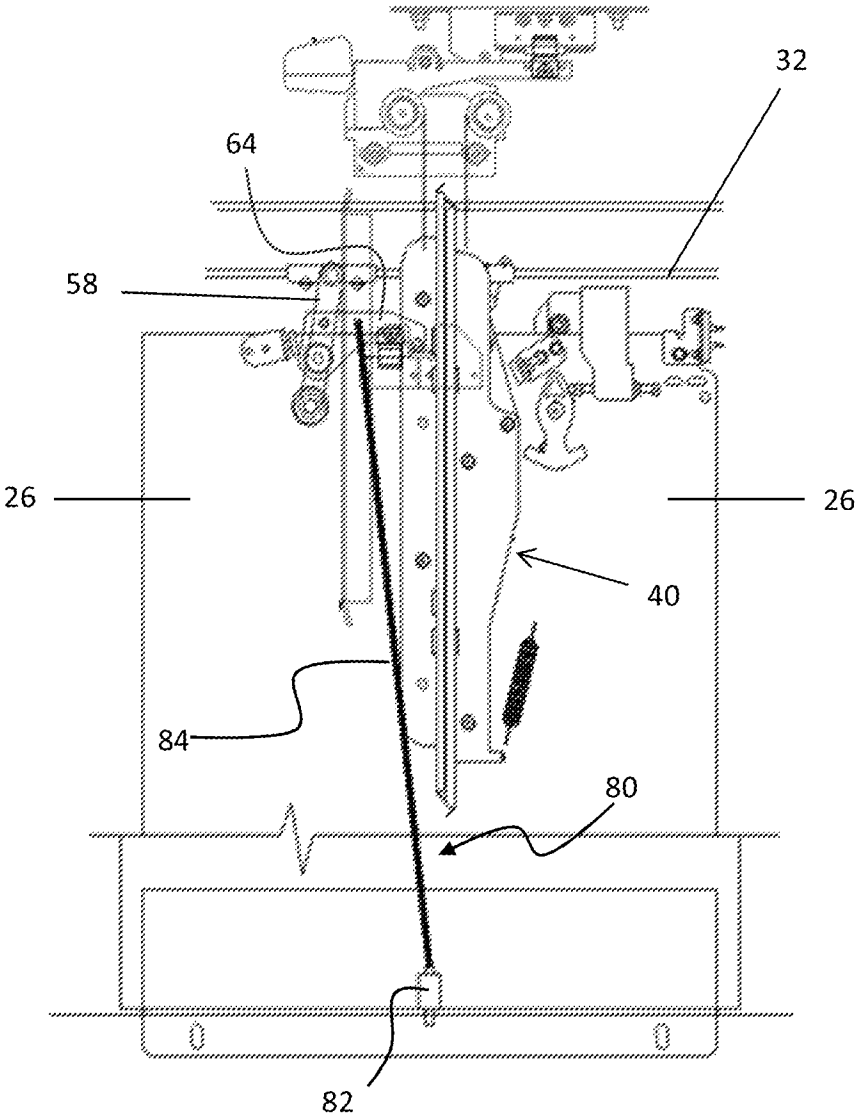
FIG. 9 is an example of a locking assembly configured to lock a lower portion of the elevator car doors according to an embodiment.

When the car doors 26 are in a closed, locked position, for example when the engagement latch 64 is in the generally horizontal position, the spring loaded pin 82 is in a first position. If the car door interlock 50 is operated in the presence of a sensing vane 52 causing the engagement latch 64 to rotate relative to the link arm 58 about pivot 66, the movement of the engagement latch 64 applies a force to the cable 84. The force is transmitted through the cable 84 to the spring loaded pin 82 causing the pin 82 to move against the bias of the spring to a second position (see FIG. 7). In the second position, the pin 82 is separated from a contact thereby allowing the car doors 26 to unlock and open. As the elevator car doors 26 are closed, the rotation of the link arm 58, and therefore the engagement latch 64, will remove the force from the cable and the spring will bias the pin 82 back to its original locked position. In instances where the door operator operates the car interlock when the elevator car 20 is not positioned within a landing door zone (FIG. 9), the engagement latch 64 will not pivot, and therefore the spring pin will remain in its first position.

The lock assembly 80 as described herein is compatible for use with various types of door couplers and interlocks, such that the lock assembly may be used in not only new elevator system, but also when retrofitting existing elevator systems. In addition, use of the lock assembly 80 in conjunction with the lock member 54 to lock both the bottom and top of the elevator car door 26 provides a higher level of safety than a conventional car door interlock. Although the lock assembly 80 is illustrated and described herein as being actuated by the car door interlock 50, embodiments where the lock assembly 80 is operated by another mechanism mounted to the car and having at least one member movable upon detection of a predetermined condition, such as a car door coupler for example, are within the scope of the disclosure.

While the disclosure has been described in detail in connection with only a limited number of embodiments, it should be readily understood that the disclosure is not limited to such disclosed embodiments. Rather, embodiments can be modified to incorporate any number of variations, alterations, substitutions, or equivalent arrangements not heretofore described but which are commensurate with the spirit and scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A lock assembly for an elevator car door, comprising:
a car door mechanism configured to move from a first position to a second position upon detection of a known condition, the car door mechanism including;
a rotatable link arm;
a sensing mechanism coupled to the rotatable link arm to detect a fixed sensing vane of a hoistway landing door; and
an engagement latch pivotally connected to the rotatable link arm, wherein the engagement latch is rotatable in response to engagement between the sensing mechanism and the sensing vane; and
a contactor mounted adjacent a lower portion of the elevator car door and operably coupled to the engagement latch, the contactor being movable in response to rotation of the engagement latch to lock and unlock a portion of the elevator car door.

2. The lock assembly according to claim 1, wherein the contactor includes a biasing mechanism configured to bias the contactor into a locked position.

3. The lock assembly according to claim 2, wherein the contactor is a spring pin.

4. The lock assembly according to claim 1, wherein the contactor is mounted to the elevator car door and engages a car door sill.

5. The lock assembly according to claim 1, wherein movement of the car door mechanism between the first position and the second position is configured to transmit a force to the contactor, thereby causing the contactor to move between a locked position and an unlocked position.

6. The lock assembly according to claim 5, wherein the contactor and the engagement mechanism are connected by a cable.

7. The lock assembly according to claim 1, wherein the car door mechanism is a car door interlock.

8. The lock assembly according to claim 1, wherein the car door mechanism is a door coupler.

9. An elevator system, comprising:
an elevator car movable within a hoistway between a plurality of landings, the elevator car including:
an elevator car door movable between an open position and a closed position;
a car door mechanism configured to determine if the elevator car is positioned within a landing door zone, the car door mechanism including;
a rotatable link arm;
a sensing mechanism coupled to the rotatable link arm to detect a fixed sensing vane of a hoistway landing door; and an engagement latch pivotally connected to the rotatable link arm, wherein the engagement latch is rotatable in response to engagement between the sensing mechanism and the sensing vane; and a lock assembly operably coupled to both the engagement latch and a lower portion of the elevator car, the lock assembly being configured to lock and unlock a portion of the elevator car door.

10. The elevator system according to claim 9, wherein the lock assembly is configured to lock a lower portion of the elevator car door.

11. The elevator system according to claim 9, wherein the lock assembly includes a contactor movable between a first position and a second position, wherein the contactor is arranged in a first position when the elevator car door is locked, and the contactor is arranged in a second position when the elevator car door is unlocked.

12. The elevator system according to claim 11, wherein the contactor includes a biasing mechanism configured to bias the contactor into the first position.

13. The elevator system according to claim 12, wherein the contactor is a spring pin.

14. The elevator system according to claim 11, wherein movement of the car door mechanism after determining that the elevator car is positioned within the landing door zone is configured to transmit a force to the contactor, thereby causing the contactor to move between the first position and the second position.

15. The elevator system according to claim 14, wherein the car door mechanism is a car door interlock.

16. The elevator system according to claim 15, wherein the car door interlock includes the engagement latch, the engagement latch being configured to move between a first position and a second position upon determining that the elevator car is positioned within the landing door zone.

17. The elevator system according to claim 9, wherein the lock assembly is operably coupled to the car door mechanism via a cable.

18. The elevator system according to claim 9, wherein the lock assembly is mounted to the elevator car and locks a lower portion of the elevator car door.

19. The elevator system according to claim 9, wherein operation of the car door interlock is driven by a door operator mounted to the elevator car.

20. The elevator system according to claim 9, further comprising a locking mechanism operably coupled to the car door mechanism, the locking mechanism being configured to lock an upper portion of the elevator car.

* * * * *